US010016068B2

(12) United States Patent
Van Huystee et al.

(10) Patent No.: US 10,016,068 B2
(45) Date of Patent: Jul. 10, 2018

(54) INFANT SUPPORT WITH PANNING AND SWAYING MOTIONS

(71) Applicant: Mattel, Inc., El Segundo, CA (US)

(72) Inventors: Maarten Van Huystee, Lancaster, NY (US); Matthew Alan Szymanski, East Aurora, NY (US); Philip R. Pyrce, Getzville, NY (US); Noah Paul Mauer, Warsaw, NY (US)

(73) Assignee: Mattel, Inc., El Segundo, CA (US)

( * ) Notice: Subject to any disclaimer, the term of this patent is extended or adjusted under 35 U.S.C. 154(b) by 40 days.

(21) Appl. No.: 15/293,791

(22) Filed: Oct. 14, 2016

(65) Prior Publication Data

US 2017/0105547 A1 Apr. 20, 2017

Related U.S. Application Data

(60) Provisional application No. 62/242,661, filed on Oct. 16, 2015.

(51) Int. Cl.

| | |
|---|---|
| ***A63G 9/16*** | (2006.01) |
| ***A47D 13/10*** | (2006.01) |
| ***A47D 15/00*** | (2006.01) |
| ***A47C 9/02*** | (2006.01) |
| *A47D 9/02* | (2006.01) |

(52) U.S. Cl.

CPC ..... *A47D 13/105* (2013.01); *A47C 9/02* (2013.01); *A47D 15/00* (2013.01)

(58) Field of Classification Search

CPC ... A63G 9/00; A63G 9/12; A63G 9/16; A63G 9/18; A63G 9/20; A47D 9/00; A47D 9/02; A47D 13/10; A47D 13/105; A63H 29/00; A63H 29/22; A63H 33/00; A63H 33/006

USPC ..... 472/118–125; 297/273, 260; 446/227

See application file for complete search history.

(56) References Cited

U.S. PATENT DOCUMENTS

| | | | | |
|---|---|---|---|---|
| 4,431,183 | A * | 2/1984 | Reimann | A63G 9/00 434/29 |
| 5,803,817 | A | 9/1998 | Stern | |
| 6,027,409 | A * | 2/2000 | Favorito | A47D 13/105 472/118 |
| 6,178,978 | B1 * | 1/2001 | Rieber | E04H 15/006 135/147 |
| 7,252,594 | B2 | 8/2007 | Armbruster et al. | |
| 7,748,063 | B2 * | 7/2010 | Chen | A47D 9/02 297/260.2 |
| 8,491,051 | B2 | 7/2013 | Zhang | |
| 8,550,927 | B2 | 10/2013 | Hunter-Jones | |

(Continued)

*Primary Examiner* — Kien Nguyen

(74) *Attorney, Agent, or Firm* — Edell, Shapiro & Finnan, LLC

(57) ABSTRACT

An improved infant support structure is disclosed herein. The swing contains a frame, a motor compartment, a hanger arm, and a seat. The frame is configured to suspend the motor compartment, the hanger arm, and the seat above the support surface. The hanger arm extends downwardly from the motor compartment, and is capable of a first type of motion and a second type of motion. The first type of motion may cause the hanger arm and seat to rotate about a vertical axis. The second type of motion may cause the hanger arm and seat to sway or swing along a substantially circular curvilinear arc within a horizontal plane. The motor compartment may cause the hanger arm and seat to simultaneously perform the first and second types of motion.

20 Claims, 19 Drawing Sheets

(56) References Cited

U.S. PATENT DOCUMENTS

| | | | | |
|---|---|---|---|---|
| 8,834,282 | B2 | 9/2014 | Sclare et al. | |
| 8,845,440 | B2 * | 9/2014 | Haut | A47D 13/10 472/119 |
| 8,967,716 | B2 | 3/2015 | Mountz | |
| 9,033,415 | B2 | 5/2015 | Hopke et al. | |
| 9,033,809 | B2 | 5/2015 | Haut et al. | |
| 2012/0205954 | A1 | 8/2012 | Pollack et al. | |
| 2013/0244802 | A1 * | 9/2013 | Robbins | A47D 13/10 472/118 |

* cited by examiner

INFANT SUPPORT WITH PANNING AND SWAYING MOTIONS

CROSS-REFERENCE TO RELATED APPLICATIONS

This application claims priority under 35 U.S.C. 119(e) to U.S. Provisional Patent Application Ser. No. 62/242,661, entitled "Infant Support with Panning and Swaying Motions," filed Oct. 16, 2015, the disclosures of which are incorporated herein by reference in their entirety for all purposes.

FIELD OF THE INVENTION

The present invention relates to an infant support. More specifically, the invention relates to an infant support with a seat that pans, or rotates about a vertical axis, while simultaneously swaying in a curvilinear motion along a horizontal plane to provide a soothing motion to an infant positioned within the seat of the infant support.

BACKGROUND OF THE INVENTION

Young children have a need to be physically stimulated. Gentle rocking in a parent's arms is one of the most basic parental stimulations. In order to provide relief to a parent from continuous holding and rocking of an infant, some infant support structures simulate the rocking or swinging motions of a parent's arms.

Various infant support structures for supporting an infant or child above a support surface are known, such as swings and rocker seats. Not only do these infant support structures simulate the rocking and swinging motions of a parent's arms, they are often used to soothe a restless infant. For example, bouncers and swings provide a gentle rocking motion to the seat, comforting an infant positioned therein. Similarly, infant gliders include a seat that moves back and forth along a support base to provide a continuous, oscillating motion that comforts an infant positioned in the seat. However, these infant support structures often provide motion in only one direction. For example, infant swings generally provide a swinging motion in a forward to backward direction. Moreover, infant rocker seats generally provide a rocking motion in a forward to backward direction. One drawback of the prior art infant support structures is that when the motion provided changes directions, the change in the motion is abrupt and jars the infant positioned in the seat.

Therefore, there is a need for an infant support structure, such as an infant swing, that simultaneously provides multiple types of motion to an infant received within a seat. In addition, there is a need for an infant support structure that provides a smoother and gentler motion, one that does not contain abrupt and harsh changes of motion, to provide a better soothing experience to the infant positioned within the seat.

SUMMARY OF THE INVENTION

According to at least one embodiment of the present invention, the infant support structure includes a frame, a motor compartment, a hanger arm, and a seat. The frame of the infant support structure includes a base and a support arm that extends upwardly from the base. The support arm is configured to suspend the motor compartment, the hanger arm, and the seat above the support surface. The hanger arm is coupled to and extends downwardly from the motor compartment, where the hanger arm is capable of at least a first type of motion and a second type of motion. The first type of motion may be a panning motion where the hanger arm rotates about a vertical axis. The second type of motion may be a substantially circular curvilinear swaying motion within a horizontal plane such that the seat coupled to the hanger arm is moved in a substantially circular arc through a horizontal plane. The motor compartment includes an upper linkage bar and a lower linkage bar. The upper linkage bar may cause the hanger arm to perform the first type of motion, while the lower linkage bar may cause the hanger arm to perform the second type of motion. The upper and lower linkage bars may operate simultaneously to cause the hanger arm, and subsequently the seat, to perform the first and second types of motion simultaneously.

BRIEF DESCRIPTION OF THE DRAWINGS

Like reference numerals have been used to identify like elements throughout this disclosure.

DETAILED DESCRIPTION OF THE INVENTION

The present invention disclosed herein is an infant support, which may be an infant support structure. The infant support includes a base, a support arm, a motor compartment, a hanger arm, and a seat. The base supports the infant support on a support surface. The support arm may extend upwardly from the base and may support a motor compartment above the support surface. Extending from and below the motor compartment is a hanger arm that suspends the seat above the support surface. The motor compartment is configured to impart two types of motion simultaneously to the hanger arm, and subsequently the seat, of the infant support. The seat of the infant support may be panned, or rotated about a vertical axis, and also swayed or swung along a substantially circular curvilinear arc through a horizontal plane.

Figure 1:
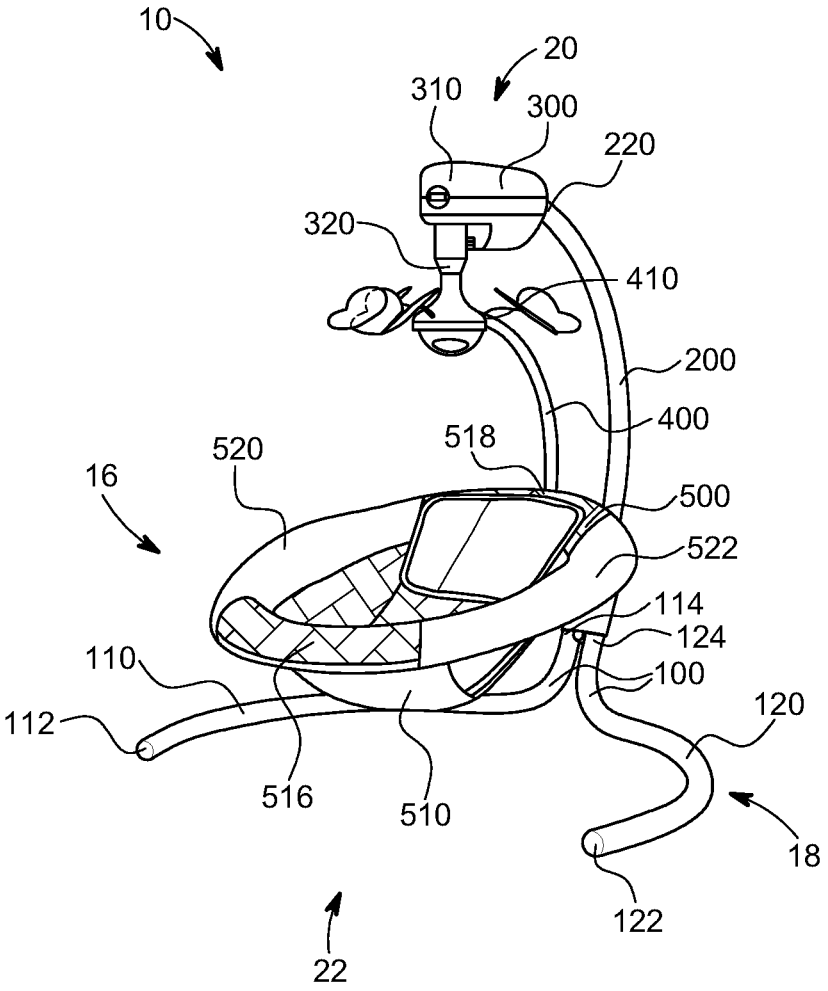
FIG. 1 illustrates a perspective view of an embodiment of an infant support structure that provides two types of motions simultaneously according to the present invention.
Figure 2:
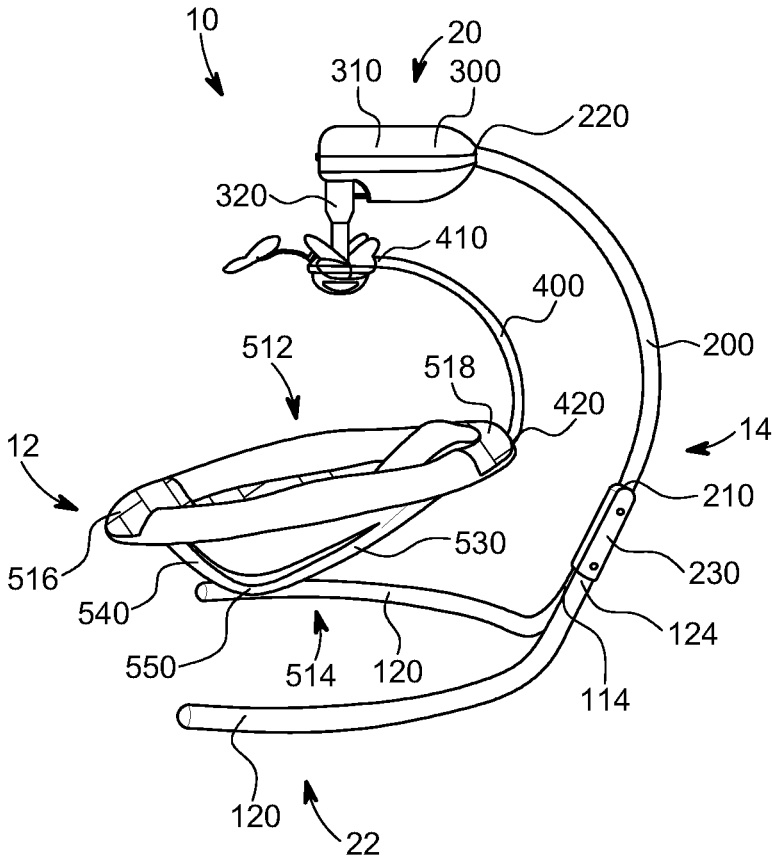
FIG. 2 illustrates a side elevation view of the embodiment of the infant support structure illustrated in FIG. 1.

Turning to FIGS. 1 and 2, illustrated is a perspective view of infant support 10. The infant support 10 may be in the form of, but not limited to, an infant swing, an infant glider, an infant bouncer, etc. The infant support 10 contains a front side 12, a rear side 14 opposite the front side 12, a first side 16, and a second side 18 disposed opposite the first side 16. In addition, the infant support structure 10 includes a top 20, and a bottom 22 disposed opposite the top 20. The bottom 22 of the infant support structure 10 is configured to rest on the support surface.

The infant support structure 10 includes a base 100, a support arm 200, a motor compartment 300, a hanger arm 400, and a seat 500. As illustrated in FIGS. 1 and 2, the base 100 includes a first base member 110 and a second base member 120. Each of the base members 110, 120 may be substantially cylindrical in shape. In other words, the cross section of each of the base members 110, 120 may be circular. Furthermore, as illustrated, the first and second base members 110, 120 may each contain a curvature. In another embodiment, the first and second base members 110, 120 may be of a different shape and curvature than that illustrated in FIGS. 1 and 2. The first and second base members 110, 120 are configured to contact and support the infant support structure 10 on the support surface. The first base member 110 includes a distal end 112 and a proximal end 114. Similarly, the second base member 120 includes a distal end 122 and a proximal end 124. The proximal ends 114, 124 of the first and second base members 110, 120 are coupled to the support arm 200.

The support arm 200, as illustrated in FIGS. 1 and 2, may also be substantially cylindrical in shape, and thus, may have a substantially circular cross section. The support arm 200 includes a distal end 210 and a proximal end 220, where the proximal end 220 is disposed farther from the support surface than the distal end 210. Furthermore, as illustrated in FIG. 2, the support arm 200 may contain a curvature that positions the proximal end 220 of the support arm 200 forward from the distal end 210 of the support arm 200. Thus, the proximal end 220 of the support arm 200 may be closer to the front side 12, while the distal end 210 of the support arm 200 may be closer to the rear side 14. Coupled to the distal end 210 of the support arm 200 is a coupler 230. The coupler 230 may be configured to receive the distal end 210 of the support arm 200 or be connected to the distal end 210 of the support arm 200. The coupler 230 is further configured to be connected to or receive the proximal ends 114, 124 of the first and second base members 110, 120 to couple the first and second base members 110, 120 to the support arm 200. In another embodiment, the support arm 200 may be of a different shape and curvature than that illustrated in FIGS. 1 and 2.

With further reference to FIGS. 1 and 2, disposed on the proximal end 220 of the support arm 200 is the motor compartment 300. The motor compartment 300 includes a first housing portion 310 and a second housing portion 320. The first housing portion 310 of the motor compartment 300, as explained in further detail below, houses the motor 340 that is configured to impart the rotational and swaying motions to the hanger arm 400 and the seat 500. Moreover, the second housing portion 320 encompasses the connection of the motor 340 to the hanger arm 400 and the coupling of the hanger arm 400 to the proximal end 210 of the support arm 200.

As previously stated, the hanger arm 400 is coupled to the proximal end 220 of support arm 200 through the second housing portion 320 of the motor compartment 300. The hanger arm 400 may also be substantially cylindrical in shape, and thus, may have a substantially circular cross section. The hanger arm 400 includes a distal end 410 and a proximal end 420, where the distal end 410 of the hanger arm 400 is coupled to the proximal end 220 of the support arm 200. The proximal end 420 of the hanger arm 400 is coupled to the seat 500. As illustrated, the proximal end 420 of the hanger arm 400 is closer to the support surface than the distal end 410 of the hanger arm 400. In other words, the distal end 410 of the hanger arm 400 is disposed at a higher height than the proximal end 420 of the hanger arm 400. Moreover, as best illustrated in FIG. 2, the hanger arm 400 may also contain a curvature that positions the proximal end 420 of the hanger arm 400 rearward from the distal end 410 of the hanger arm 400. Thus, the proximal end 420 of the hanger arm 400 may be closer to the rear side 14, while the distal end 410 of the hanger arm 400 may be closer to the front side 12. Furthermore, because the distal end 410 of the hanger arm is coupled to the proximal end 220 of the support arm 200 through the motor compartment 300, the motor 340 of the motor compartment 300 may impart motion onto the hanger arm 400, which is then translated to the seat 500.

With continued reference to FIGS. 1 and 2, the seat 500 receives and supports and infant therein. The seat 500 may possess a generally oval shape defined by the frame 510. The frame 510 of the seat 500 has a top side 512 and a bottom side 514, where the top side 512 generally concave and configured to receive and support an infant. It then follows that the bottom side 514 of the frame 510 is generally convex. The frame 510 further includes a front end 516, a rear end 518 opposite the front end 516, a first side 520, and a second side 522 opposite the first side 520. The proximal end 420 of the hanger arm 400 is coupled to the bottom side 514 of the frame 510 of the seat 500, proximate to the rear end 518, such that the seat 500 is suspended above the support surface by the hanger arm 400.

The frame 510 may contain an L-shaped structure spanning from the rear end 518 to the front end 516, where the L-shaped structure contains a trunk or torso portion 530 and a leg or foot portion 540. The trunk portion 530 may be oriented at an acute angle with respect to the foot portion 540. In other embodiments, the angle between the trunk portion 530 and the foot portion 540 can vary. The trunk portion 530 may possess a length (longitudinal dimension) that is greater than the length (longitudinal dimension) of the foot portion 520. With this described configuration, the bottom side 514 possesses a lowermost point 550 that is longitudinally offset along the seat 500. That is, the lowermost point 550 is located closer to the front end 516 than to the rear end 518. This difference in length provides greater support area for the trunk or torso of an infant and less for the legs of the infant, which often may be folded while resting or sleeping. Furthermore, the seat 500 may contain a three point restraint system (not shown) or a five point restraint system (not shown) to secure an infant to the seat 500, preventing the infant from falling out of the seat 500.

Figure 3:
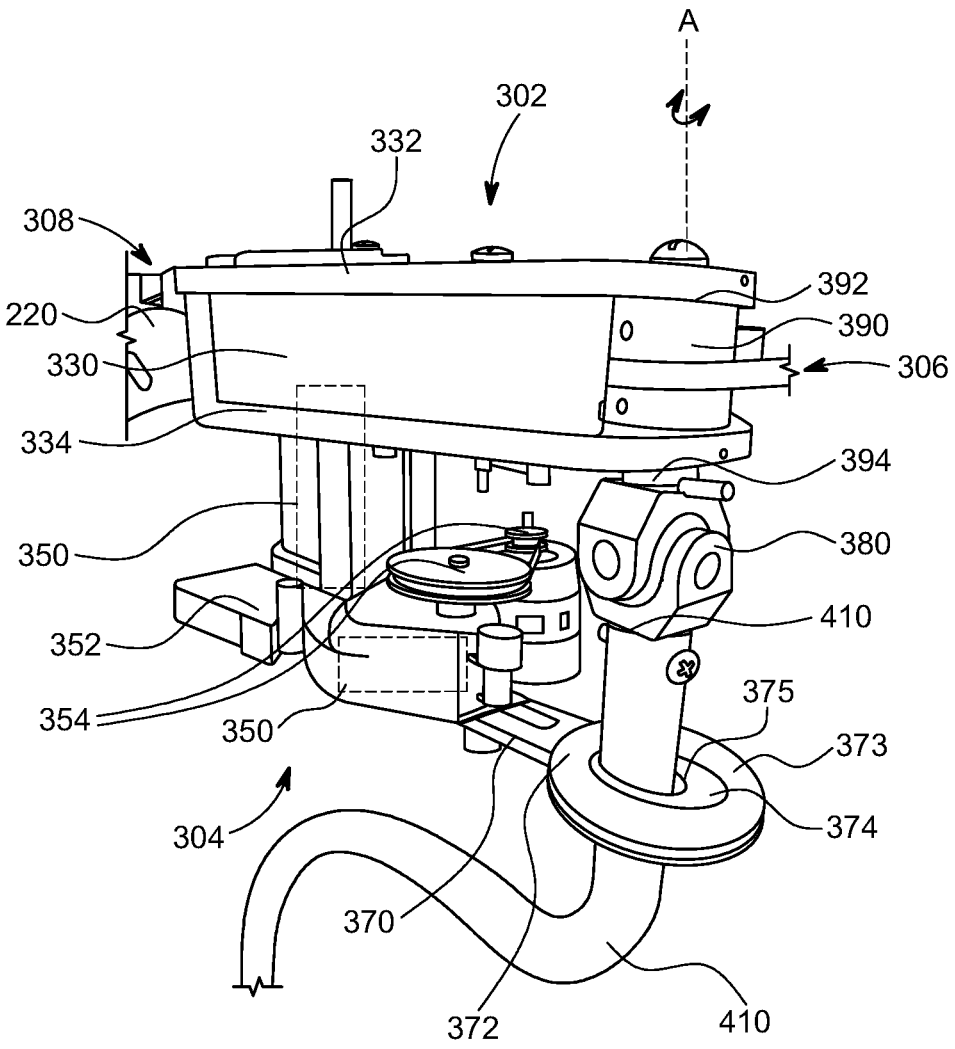
FIG. 3 illustrates a side elevation view of the motor compartment of the embodiment of the infant support structure illustrated in FIG. 1.
Figure 4:
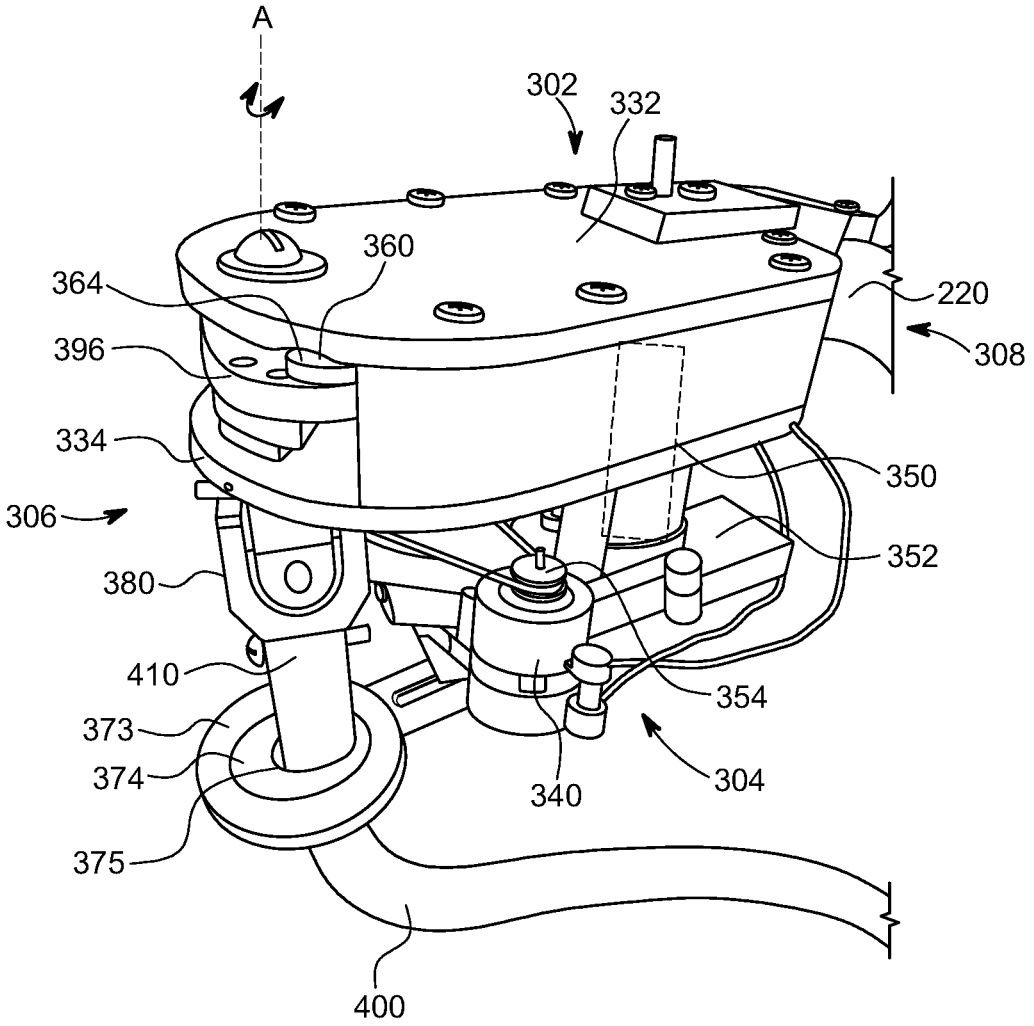
FIG. 4 illustrates a perspective view of the motor compartment illustrated in FIG. 3.
Figure 5:
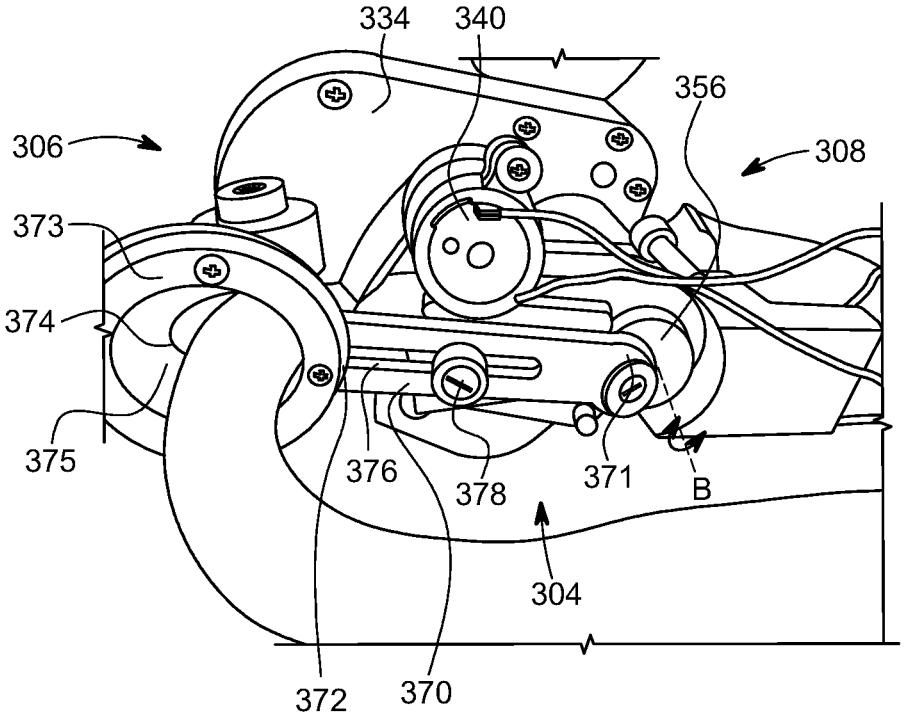
FIG. 5 illustrates a bottom view of the motor compartment illustrated in FIG. 3.

Turning to FIGS. 3-5, illustrated is a first embodiment of the motor compartment 300 with the first and second housing portions 310, 320 removed. The motor compartment 300 houses the motor 340, a set of gears 350, an upper linkage 360, and a lower linkage 370. As previously stated, the motor compartment 300 further houses the connection of the distal end 410 of hanger arm 400 to the support arm 200 and the motor compartment 300. The motor compartment 300 includes a top side 302, a bottom side 304 disposed opposite the top side 302, a front end 306, and a rear end 308 disposed opposite the front end 306. The motor compartment 300 further includes an inner frame 330, which contains an upper platform 332 and a lower platform 334 that are spaced from one another. As illustrated, the proximal end 220 of the support arm 200 is coupled to the inner frame 330 of the motor compartment 300 proximate to the top side 302 and the rear end 308 of the motor compartment 300. Thus, the motor compartment 300 is suspended from the proximal end 220 of the support arm 200 over the support surface.

Furthermore, an upper rotational arm 390 is coupled to the inner frame 330 of the motor compartment 300 proximate to the front end 306 of the motor compartment 300. As best illustrated in FIGS. 3 and 4, the upper rotational arm 390 includes a distal end 392 and a proximal end 394. The distal end 392 of the upper rotational arm 390 is rotatably coupled to the upper platform 332 of the inner frame 330 and configured to extend downwardly from the upper platform 332 and through the lower platform 334 of the inner frame 330 such that the proximal end 394 of the upper rotational arm 390 is disposed below the lower platform 334 of the inner frame. The upper rotational arm 390 is configured to rotate about a vertical axis A that passes longitudinally through the center of the upper rotational arm 390. The proximal end 334 of the upper rotational arm 390 is coupled to a universal joint 380. As best illustrated in FIG. 4, the upper rotational arm 390 includes an extension 396 disposed on the upper rotational arm 390 between the distal end 392 and the proximal end 394. Thus, as illustrated, the extension 396 is disposed in the space between the upper platform 332 and the lower platform 334. The extension 396 extends horizontally from the upper rotational arm 390. As further illustrated in FIGS. 3 and 4, the distal end 410 of the hanger arm 400 is also coupled to, and extending downwardly from, the universal joint 380. The distal end 410 of the hanger arm 400 is coupled to the universal joint 380 opposite of that of the upper rotational arm 390. It then follows that rotation of the upper rotational arm 390 about axis A translates rotational motion to the hanger arm 400. In other words, rotation of the upper rotational arm 390 also rotates the hanger arm 400. The universal joint 380 enables the hanger arm 400 to move (pivot, sway, etc.) 360 degrees with respect to the upper rotational arm 390. The universal joint 380, however, still translates the rotation of the upper rotational arm 390 to the hanger arm 400. In another embodiment of the infant support structure 10 illustrated in FIG. 12, a resilient member 382 may couple the proximal end 394 of the upper rotational arm 390 to the distal end 410 of the hanger arm 400. Thus, the resilient member 382 may perform in a similar manner to that of the universal joint 380 to also enable the hanger arm 400 to move (pivot, sway, etc.) 360 degrees with respect to the proximal end 394 of the upper rotational arm 390. Similar to the universal joint 380, the resilient member 382 may still translate the rotation of the upper rotational arm 390 to the hanger arm 400.

With further reference to FIGS. 3-5, the motor 340 disposed within motor compartment 300 may be an electric motor. As best illustrated in FIGS. 3 and 4, the motor 340 is mechanically coupled to a pulley drive 354, which is mechanically coupled to the set of gears 350. Thus, powering the motor 340 causes the components of the pulley drive 354 to rotate, which in turn, cause the set of gears 350 to rotate. FIGS. 3-5 further illustrated that the motor 340, the set of gears 350, and the pulley drive 354 are disposed within the motor compartment 300 below the lower platform 334 of the inner frame 330. The motor 340, the set of gears 350, and the pulley drive 354 may be housed within, or coupled to, a casing 352. As illustrated, the casing 352 is coupled to, and extends downwardly from, the lower platform 334 of the inner frame 330. While not illustrated, the set of gears 350 extends upwardly through the lower platform 334 of the inner frame and into the space between the lower platform 334 and the upper frame 332. The upper linkage bar 360, which is best illustrated in FIG. 4, is disposed in the space between the lower platform 334 and the upper frame 332, and may be coupled to one of the gears of the set of gear 350. The upper linkage bar 360 contains a distal end 362 and a proximal end 364, where the distal end 362 may be coupled to the one of the gears 350 at a location offset from the center of the gear 350. Moreover, the proximal end 364 of the upper linkage bar 360 may be coupled to the extension 396 of the upper rotational arm 390. Thus, rotation of the set of gears 350 causes the upper linkage bar 360 to move substantially linearly through the space between the upper platform 332 and the lower platform 334 in a forward to backward direction. This substantially linear movement of the upper linkage bar 360 causes the extension 396, and thus, the upper rotational arm 390, to rotate about axis A. It then follows that the substantially linearly movement of the upper linkage bar 360 causes the hanger arm 400 to rotate about axis A.

Figure 6A:
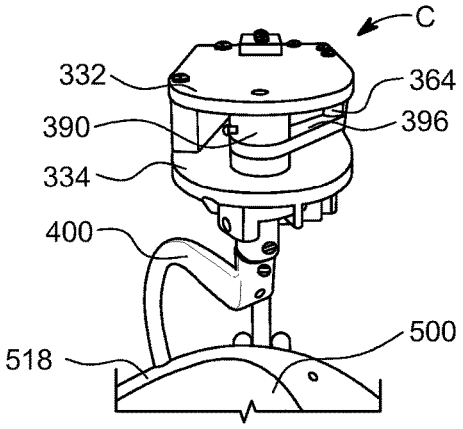
FIG. 6A illustrates the upper rotational arm of the motor compartment illustrated in FIG. 3 in a first position.
Figure 6B:
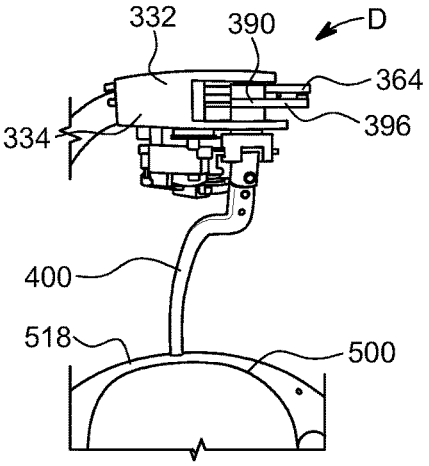
FIG. 6B illustrates the upper rotational arm of the motor compartment illustrated in FIG. 3 in a second position.

Turning to FIGS. 6A and 6B, illustrated is first and the second positions C, D of the upper rotation member 390. FIG. 6A illustrates the upper rotational member 390 in the first position C, while FIG. 6B illustrates the upper rotational member 390 in the second position D. When in the first position C, the extension 396 of the upper rotation member 390 is disposed closer to the rear end 308 of the motor compartment 300 than when the upper rotation member 390 is in the second position D. As further illustrated, and previously explained, the rotation of the upper rotational member 390 about axis A is caused by the substantially linear movement of the upper linkage bar 360 being coupled to a rotating gear 350 at a location on the gear 350 that is offset from the center of the gear 350. As illustrated in FIG. 6A, the upper linkage bar 360 has pulled the extension 396 toward the rear end 308 of the motor compartment 300, where in FIG. 6B, the upper linkage bar 360 has pushed the extension 396 toward the front end 306 of the motor compartment 300. In the first position, illustrated in FIG.

Figure 6C:
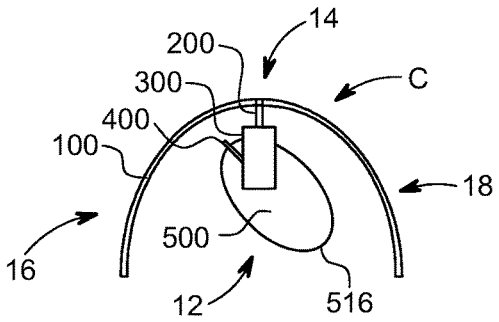
FIG. 6C illustrates a schematic top view of the infant support structure illustrated in FIG. 1 when the upper rotational arm is in the first position.
Figure 6D:
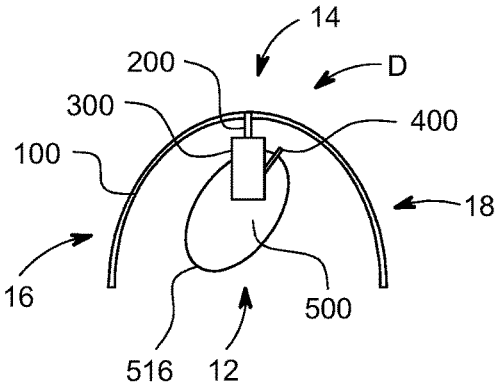
FIG. 6D illustrates a schematic top view of the infant support structure illustrated in FIG. 1 when the upper rotational arm in the second position.
Figure 7A:
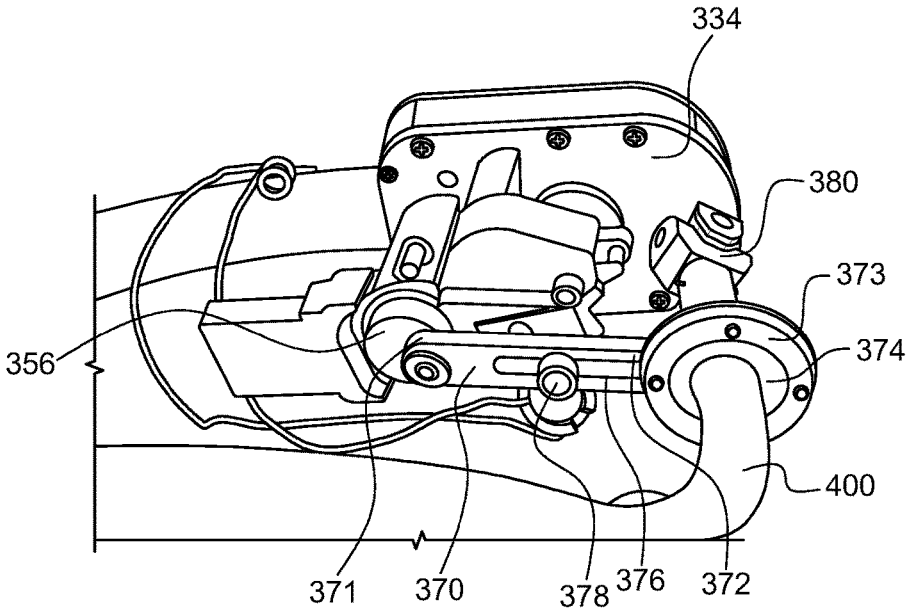
FIGS. 7A-7D illustrate the various positions of the lower linkage bar of the motor compartment illustrated in FIG. 3.
Figure 7B:
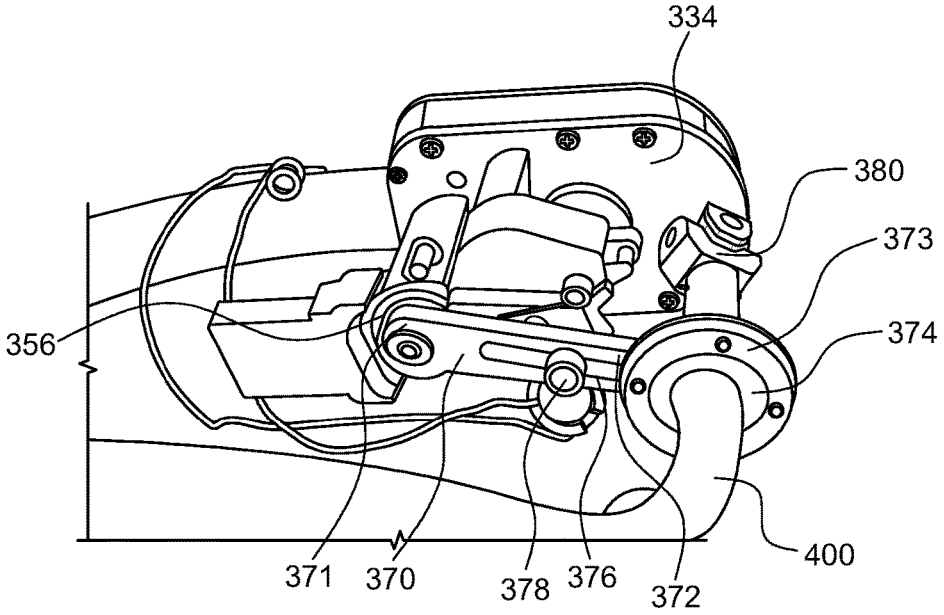
Figure 7C:
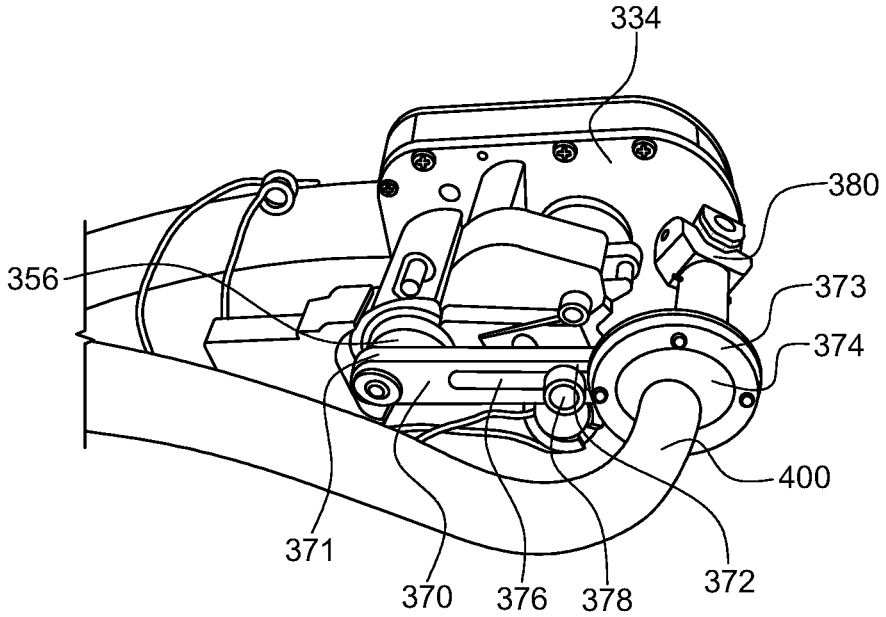
Figure 7D:
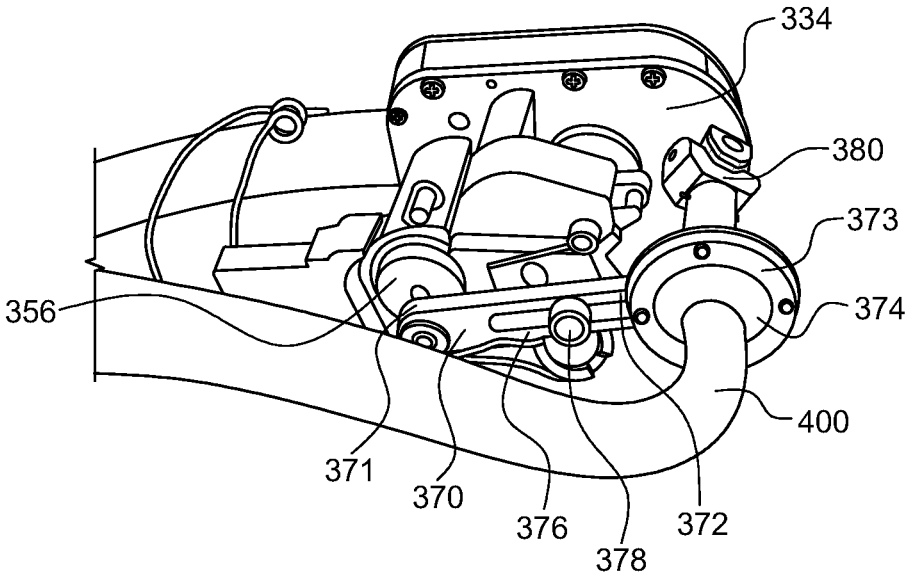

6A, the upper rotational arm 390 has rotated counterclockwise to its farthest point, and, as illustrated in the schematic overhead view of FIG. 6C, the seat 500 has been rotated such that the front end 516 of the seat 500 faces substantially towards the second side 18 of the infant support structure 10. Conversely, as illustrated in FIG. 6B, the upper rotational arm 390 has rotated clockwise to its farthest point, and, as illustrated in the schematic overhead view of FIG. 6D, the seat 500 has been rotated such that the front end 516 of the seat 500 faces substantially towards the first side 16 of the infant support structure 10.

Returning to FIG. 5, extending below the casing 352 is a lower gear or wheel 356. The lower gear 356 is configured to rotate about vertical axis B that passes through the center of the lower gear 356. Coupled to the lower gear 356 is the lower linkage bar 370. The lower linkage bar 370 contains a distal end 371 and a proximal end 372. The distal end 371 of the lower linkage bar 370 is coupled to the lower gear 356 at a location that is offset from the center of the lower gear 356. Moreover, the lower linkage bar 370 contains a slot 376 that extends the length of the lower linkage bar 370 between the distal end 371 and the proximal end 372. A fastener 378, such as a pin, is disposed through the slot 376 to movably couple the lower linkage bar 370 to the casing 352. In addition, a ring 373 is disposed on the proximal end of the lower linkage bar 370, where the ring 373 is disposed around the hanger arm 400 proximate to the distal end 410 of the hanger arm 400. The ring 373 further includes a gasket 374, which contains an opening 375 that is larger in diameter than the cross sectional diameter of the hanger arm 400. The gasket 374 also is disposed around the hanger arm 400 proximate to the distal end 410 of the hanger arm 400. In other words, the distal end 410 of the hanger arm 400 is inserted through the gasket 374 and the ring 373. The gasket 374 may be constructed from a resilient material, such as, but not limited to, rubber.

Figure 12:
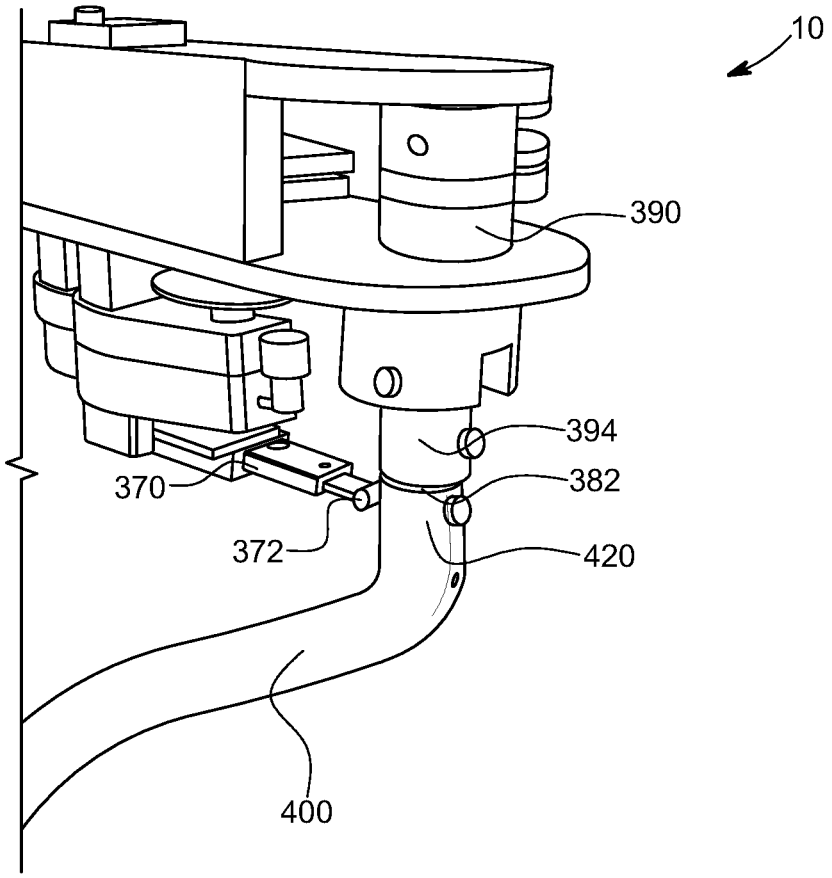
FIG. 12 illustrates a perspective view of the second embodiment of motor compartment illustrated in FIG. 9, where the lower linkage bar is ramming the hanger arm.

Turning to FIGS. 7A-7D, illustrated is the operation of the lower linkage bar 370 to facilitate a circular swaying motion to the seat 500. FIGS. 7A-7D illustrate a full rotation, or cycle, of the lower gear 356 and the positioning of the lower linkage bar 370 throughout the rotation of the lower gear 356. As illustrated in FIGS. 7A-7D, the lower gear 356 rotates in a counterclockwise manner about a vertical axis B. In operation, as the lower gear 356 rotates, the lower linkage bar 370 is moved in a substantially linearly direction (back and forth toward the front end 306 and the rear end 308 of the motor compartment 300) while also pivoting about the fastener 378 that is inserted through the slot 376 of the lower linkage bar 370. This motion of the lower linkage bar 370, coupled with the ring 373 and gasket 374 disposed around the hanger arm 400, causes the hanger arm 400, and subsequently the seat 500, to sway in a counterclockwise curvilinear arc. The resiliency of the gasket 374 allows the lower linkage bar 370 to transmit motion onto the hanger arm 400, while also providing cushioning and dampening to the motion of the hanger arm 400. Thus, the resiliency of the gasket 374 causes the hanger arm 400, and thus the seat 500, to move in a substantially circular curvilinear arc with a smooth, gentle, and continuous motion. The universal joint 380 further enables the hanger arm 400 and the seat 500 to be moved in the substantially circular curvilinear arc as the operation of the lower linkage bar 370 imparts the motion onto the hanger arm 400. While not depicted, the lower linkage bar 370 with ring 373 and gasket 374 would perform the same function to the embodiment of the hanger arm 400 that is coupled to upper rotational arm 390 via a resilient member 382, as illustrated in FIG. 12. In addition, as described below with reference to FIGS. 9 and 10, when the lower linkage bar 370 does not include a ring 373 and gasket 374, the lower linkage bar 370 is configured to ram or push the hanger arm 400 with the proximal end 372 to transmit motion onto the hanger arm 400. This second embodiment of the lower linkage bar 370 may also be used with either a universal joint 380 or a resilient member 382 coupling the hanger arm 400 and the upper rotational arm 390 together to cause the hanger arm 400 and seat 500 to move in similar manner to that of the substantially circular curvilinear arc, as described previously.

Figure 8A:
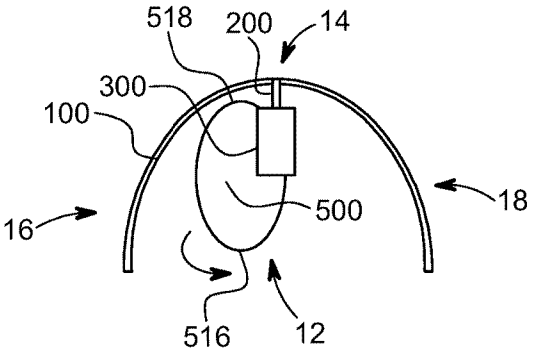
FIGS. 8A-8D illustrate schematic top views of the infant support structure illustrated in FIG. 1, the seat being located in various positions as the lower linkage bar completes a full cycle as illustrated in FIGS. 7A-7D.
Figure 8B:
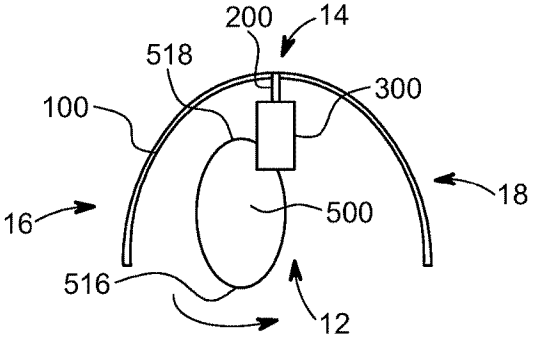
Figure 8C:
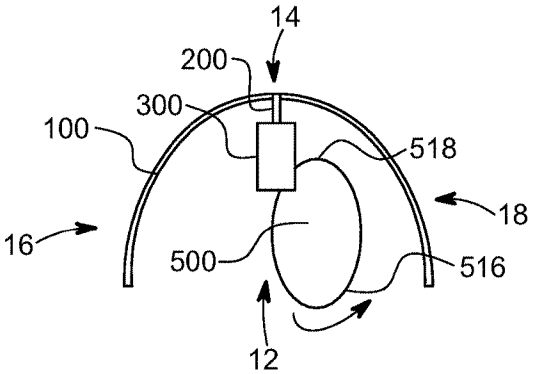
Figure 8D:
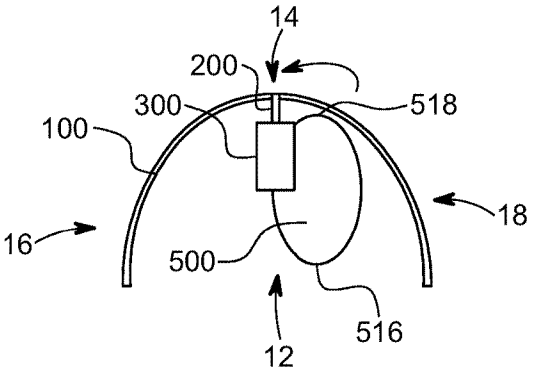

FIGS. 8A-8D illustrate a schematic overhead view of the movement to the seat 500 caused by the operation of the lower gear 356 and the lower linkage bar 370. FIGS. 8A-8D illustrated the movement of the seat 500 by the lower linkage bar 370, but do not illustrate the simultaneous rotational movement of the seat 500 by the upper linkage bar 360. As illustrated, the seat 500 moves in a generally circular motion and in a counterclockwise motion. In FIG. 8A, the seat 500 is located proximate to the first side 16 and the rear side 14. In FIG. 8B, the seat 500 has moved in a curvilinear motion from the position illustrated in FIG. 8A to a position proximate to the first side 16 and the front side 12. In FIG. 8C, the seat 500 has moved in a curvilinear motion from the position illustrated in FIG. 8B to a position proximate the second side 18 and the front side 12 of the infant support structure 10. Finally, as illustrated in FIG. 8D, the seat 500 has moved in a curvilinear motion from the position illustrated in FIG. 8C to a position proximate to the second side 18 and the rear side 14 of the infant support structure 10. The seat 500 is configured to move fluidly and continuously between the positions illustrated in FIGS. 8A-8D when the lower linkage bar 370 is moved via the lower gear 356. Moreover, the seat 500 is moved in a substantially circular and curvilinear arc through a horizontal plane.

Figure 9:
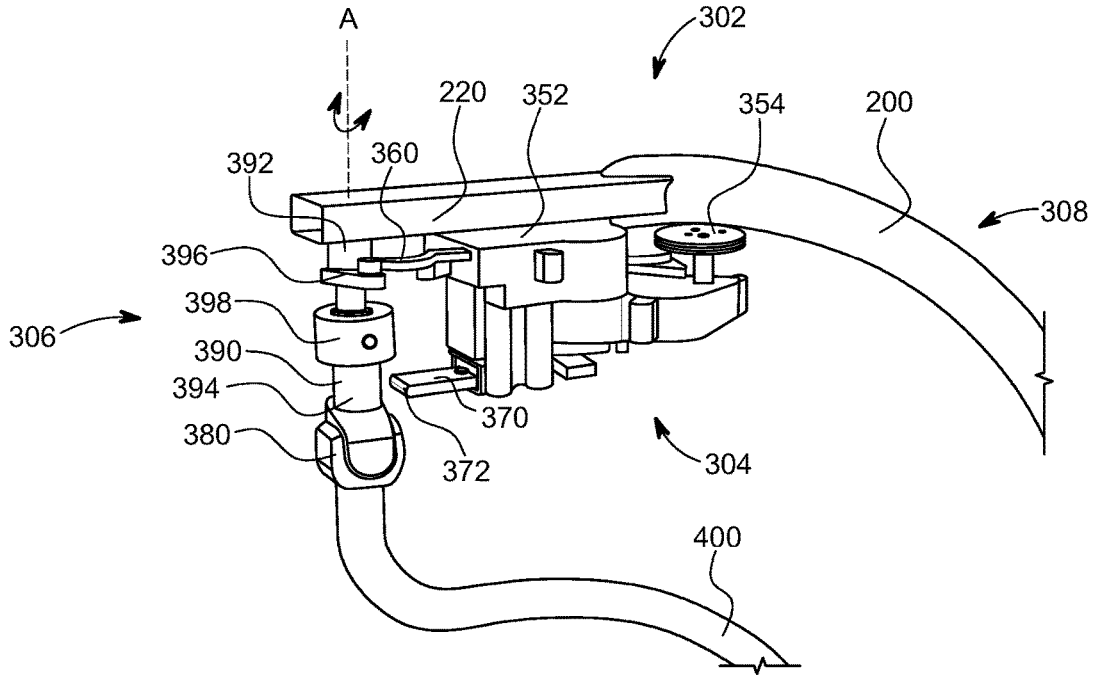
FIG. 9 illustrates a side elevation view of a second embodiment of the motor compartment of an infant support according to the present invention.
Figure 10:
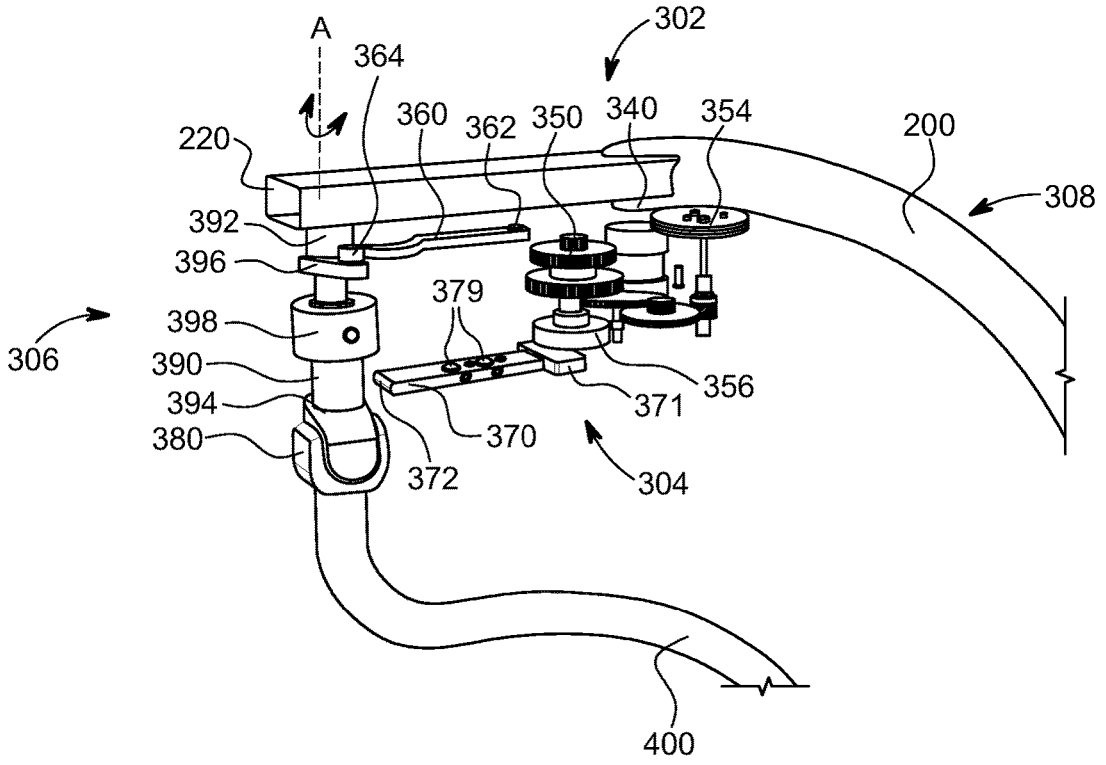
FIG. 10 illustrates a side elevation view of the inner components of the motor compartment illustrated in FIG. 9.
Figure 11A:
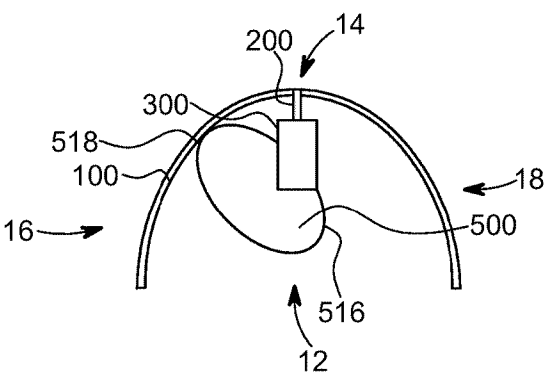
FIGS. 11A-11H illustrate schematic top views of the infant support structure illustrated in FIG. 1, the seat of the infant support structure being moved to various positions by the upper and lower linkage bars.
Figure 11B:
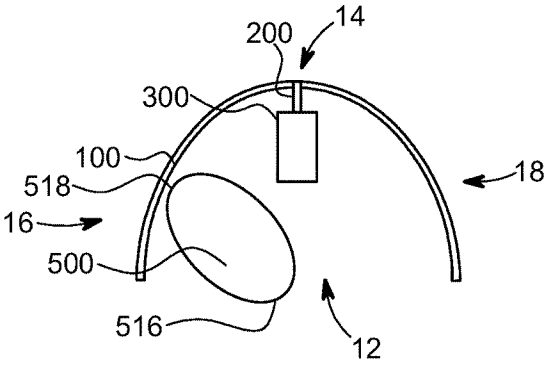
Figure 11C:
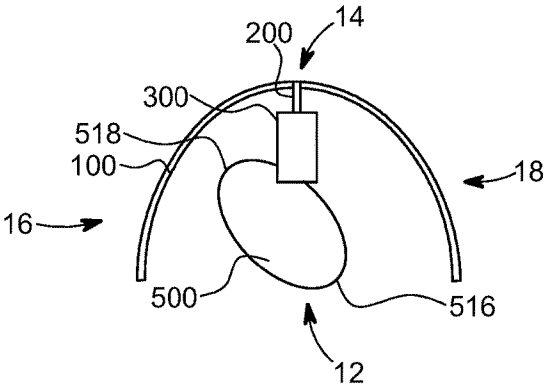
Figure 11D:
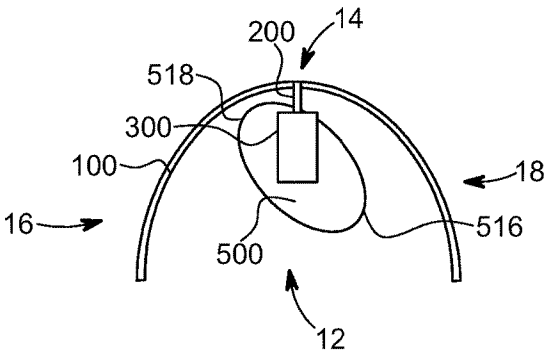
Figure 11F:
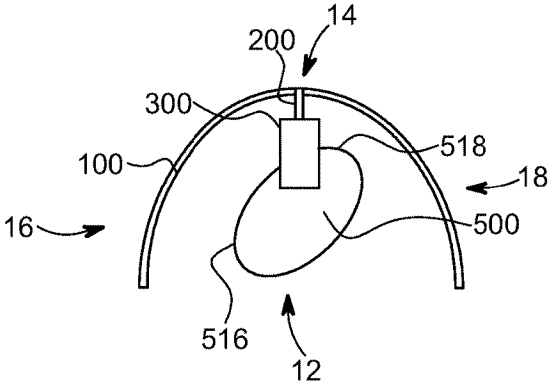
Figure 11H:
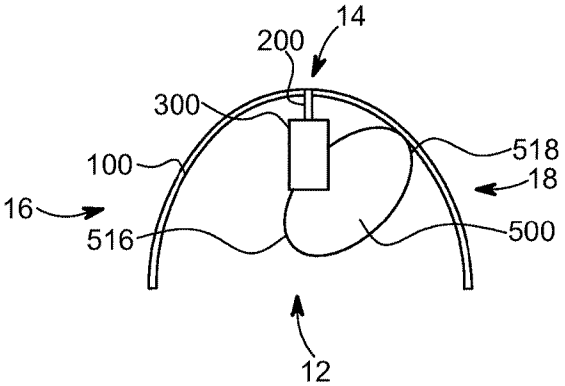
Figure 11E:
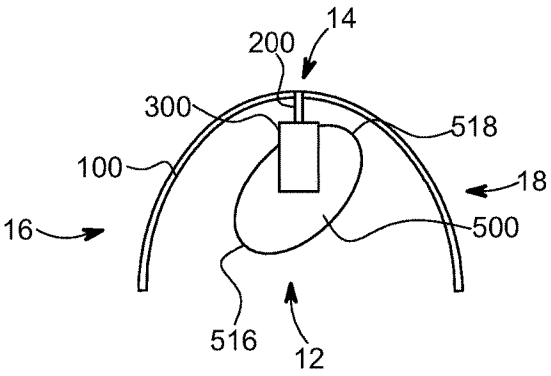
Figure 11G:
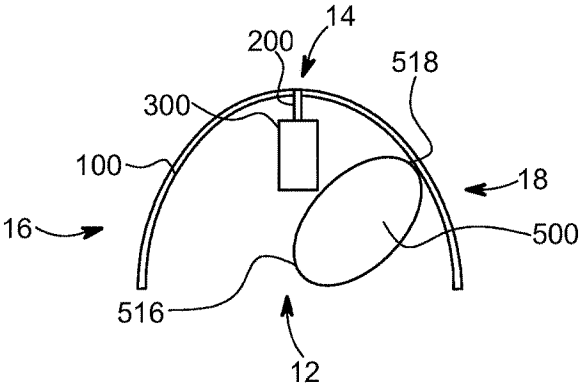

Turning to FIGS. 9 and 10, illustrated is a second embodiment of the motor compartment 300. The motor compartment 300 illustrated in FIGS. 9 and 10 operates in a substantially similar manner as that described for the motor compartment illustrated in FIGS. 3-5. Thus, the second embodiment of the motor compartment 300 imparts the same or substantially similar motion onto the hanger arm 400 and the seat 500. As illustrated in FIGS. 9 and 10, the motor compartment 300 is coupled to, and extends downwardly from, the proximal end 220 of the support arm 200. In the second embodiment of the motor compartment 300, the distal end 392 of the upper rotational arm 390 is directly coupled to the proximal end 220 of the support arm 200. The upper rotational arm 390 is configured to rotate about vertical axis A, which, as described previously, passes longitudinally through the upper rotational member 390. The upper rotational member 390 of the second embodiment of the motor compartment 300 further includes a ball and socket joint 398 that is pinned for pivotal movement. The ball and socket joint 398 provides an additional degree of movement to the hanger arm 400 and the seat 500 beyond the movements about the universal joint 380 and the rotational movement about the vertical axis A by the upper rotating arm 390.

The second embodiment of the motor compartment 300 further differs from the first embodiment in the positioning of the motor 340, the pulley drive 354, and the set of gears 350. As best illustrated in FIG. 10, the motor 340 is disposed proximate to the rear end 308 of the motor compartment 300. Thus, the pulley drive 354 and the set of gears 350 are disposed within the motor compartment 300 proximate to the rear end 308 of the motor compartment 300. In addition, the casing 352, not only encases, or houses, the sets of gears 350, but also slidably captures the upper linkage bar 360 and the lower linkage bar 370. As illustrated in FIG. 9, the upper linkage bar 360, by being at least partially slidably captured by the casing 352, is caused to move in a substantially linear motion to cause the rotation of the extension 396 of the upper rotational arm 390.

In addition, FIG. 9 further illustrates that the lower linkage bar 370 is configured to slide through the lower portion of the casing 352. The lower linkage bar 370 of the second embodiment of the motor compartment 300 does not include a ring 373 and gasket 374 like that of the lower linkage bar 370 of the first embodiment of the motor compartment 300. Thus, the proximal end 372 of the lower linkage bar 370 illustrated in FIGS. 9 and 10 is configured to contact and push the upper rotational arm 390 while moving back and forth in a substantially linear manner through the lower portion of the casing 352. The lower linkage bar 370 contacting the lower portion of the upper rotational arm 390 (portion below the ball and socket joint 398) causes the lower portion of the upper rotational arm 390 to pivot about the ball and socket joint 398 with respect to the upper portion of the upper rotational arm 390 (portion above the ball and socket joint 398). This movement further causes the hanger arm 400, and subsequently the seat 500, to sway about the universal joint 380. Because the lower linkage bar 370 is not disposed around the hanger arm 400 or the upper rotational arm 390, the linear movement of the lower linkage bar 370 must be in phase with the swaying of the seat 500 and the hanger arm 400. In this second embodiment, if the seat 500 or hanger arm 400 is bumped during operation, the swaying of the hanger arm 400 and the seat 500 may become out of phase with the substantially linear movement of the lower linkage bar 370, which would prevent the lower linkage bar 370 from contacting the hanger arm 400 or the upper rotation arm 390. In addition, as best illustrated in FIG. 10, the lower linkage bar 370 may include at least one wheel 379 disposed in the lower linkage bar 370 between the distal and proximal ends 371, 372 to facilitate smoother and more fluid movement of the lower linkage bar 370 through the lower portion of the casing 352.

FIGS. 11A-11H illustrate a schematic overhead view of the movement to the seat 500 during simultaneous operation of the upper linkage bar 360 and of the lower linkage bar 370. As described previously, the upper linkage bar 360 causes the seat 500 to rotate or pan about a vertical axis. Moreover, the lower linkage bar 370 causes the seat 500 to sway in a substantially circular curvilinear motion through a horizontal plane. The simultaneous motions caused by the upper and lower linkage bars 360, 370 cause the seat 500 of the infant support structure 10 to provide a unique and superior soothing motion to an infant disposed within the seat 500 of the infant support structure 10.

Figure 13:
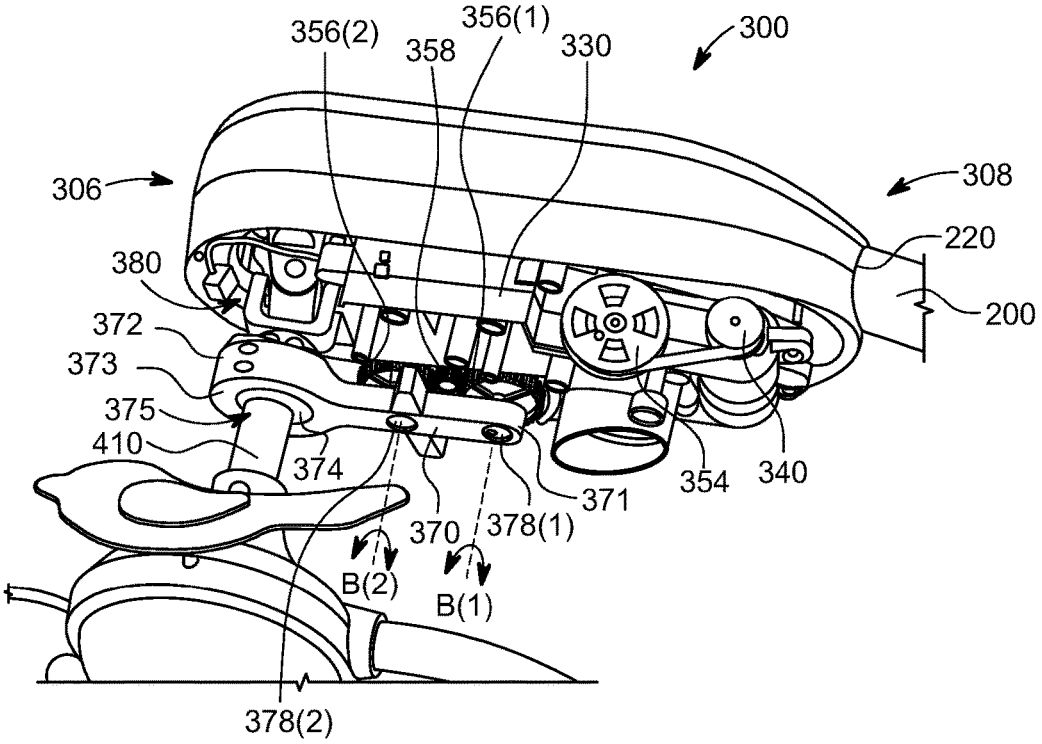
FIG. 13 illustrates a side elevation view of a third embodiment of the motor compartment of an infant support according to the present invention.
Figure 14:
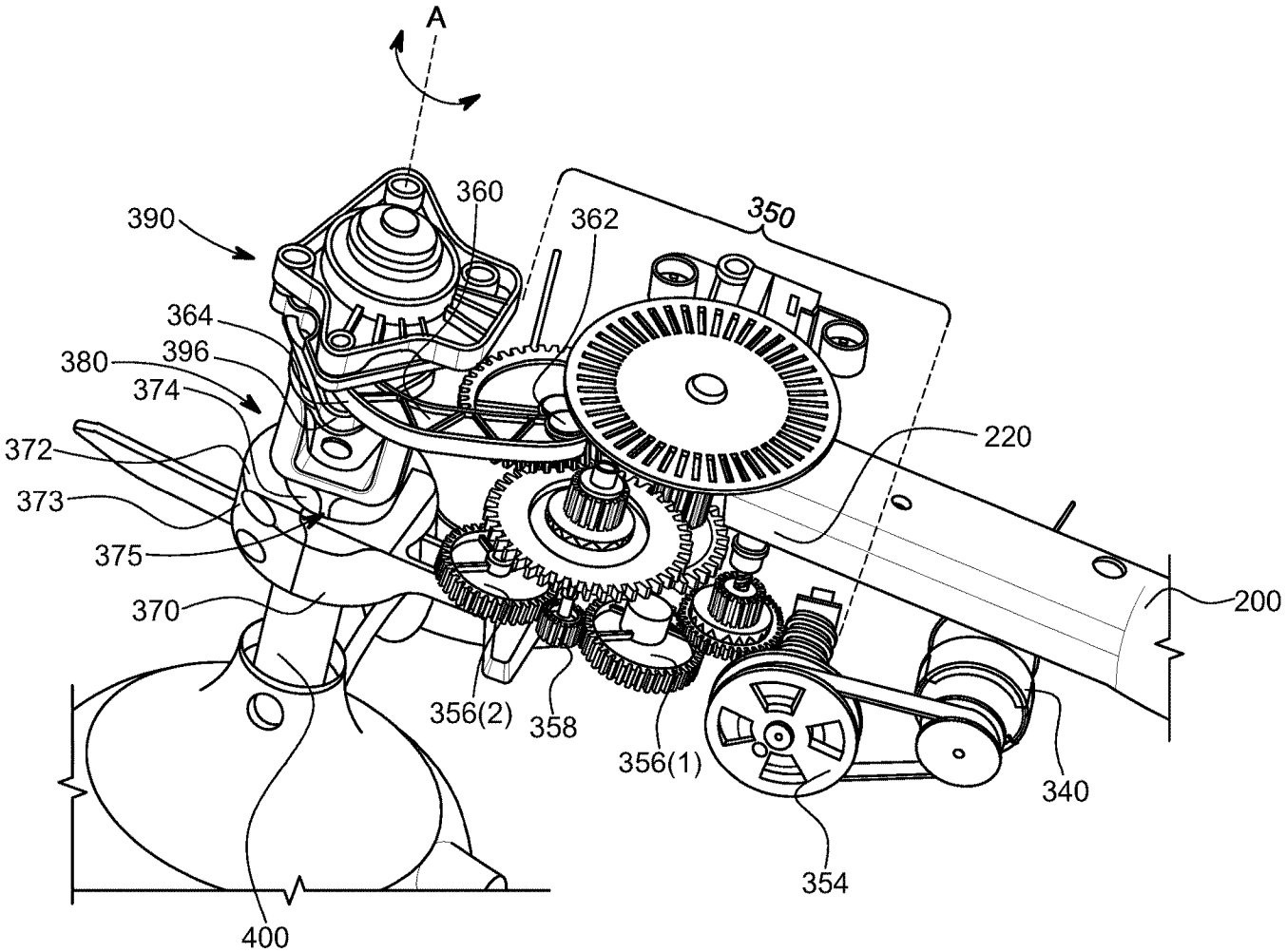
FIG. 14 illustrates a perspective view of the inner components of the motor compartment illustrated in FIG. 13.

Turning to FIGS. 13-16, illustrated is a third embodiment of the motor compartment 300 in accordance with the present invention. The motor compartment 300 illustrated in FIGS. 13-16 operates in a substantially similar conceptual manner as that described for the first embodiment of the motor compartment illustrated in FIGS. 3-5 and the second embodiment of the motor compartment illustrated in FIGS. 9 and 10. Thus, the third embodiment of the motor compartment 300 imparts a substantially similar motion onto the hanger arm 400 and the seat 500. While all the embodiments may impart the same rotational movement to the hanger arm 400 and the seat 500, the third embodiment of the motor compartment 300 may impart a different swaying motion compared to the first and second embodiments of the motor compartment. The third embodiment of the motor compartment 300 imparts a virtually complete circular swaying motion onto the hanger arm 400 and the seat 500, where the first and second embodiments may impart a substantially circular swaying motion (e.g., oval, egg-shaped, semi-circular, etc.). As illustrated in FIGS. 13 and 14, the motor compartment 300 is coupled to the proximal end 220 of the support arm 200. The motor compartment 300 houses the motor 340, the set of gears 350, the upper linkage 360, the lower linkage 370, and the upper rotational arm 390. The motor compartment 300 includes a front end 306, and a rear end 308 disposed opposite the front end 306. As illustrated, the proximal end 220 of the support arm 200 is coupled to the motor compartment 300 proximate to the rear end 308 of the motor compartment 300. Thus, the motor compartment 300 is suspended from the proximal end 220 of the support arm 200 over the support surface.

The third embodiment of the motor compartment 300 further includes an inner frame 330 that differs from the inner frame 330 of the first embodiment in that the inner frame 330 of third embodiment does not include an upper platform 332 and a lower platform 334 that are spaced from one another. The inner frame 330 of the third embodiment of the motor compartment 300 may be in the form of a box-type housing supporting the motor 340 and the set of gears 350 of the motor compartment 300.

Furthermore, the upper rotational arm member 390 is rotatably disposed proximate to the front 306 of the motor compartment 300. While not being disposed within the inner frame 330, the upper rotation arm 390 may be coupled to the exterior of the inner frame 330 proximate to the front end 306 of the motor compartment 300 such that the upper rotational arm 390 is still configured to rotate about axis A, which passes longitudinally through the center of the upper rotational arm 390. Similar to the first embodiment, the upper rotational arm 390 is coupled to a universal joint 380. As best illustrated in FIG. 14, the upper rotational arm 390 includes an extension 396. The extension 396 extends horizontally from the upper rotational arm 390. As further illustrated in FIGS. 13-15, the distal end 410 of the hanger arm 400 is coupled to the universal joint 380 opposite of that of the upper rotational arm 390. It then follows that, similar to the first and second embodiments, rotation of the upper rotational arm 390 about axis A translates rotational motion to the hanger arm 400 about axis A.

Figure 15:
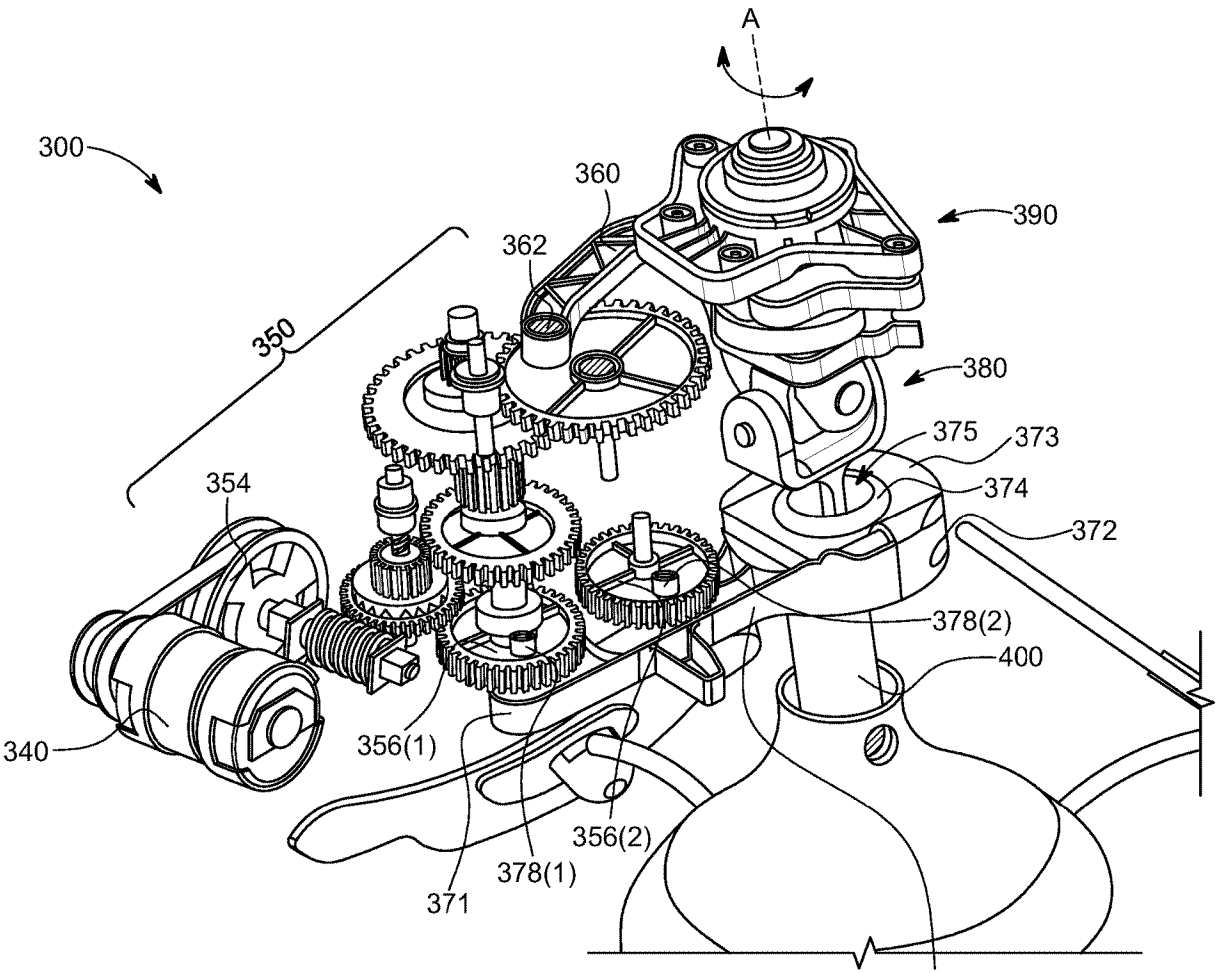
FIG. 15 illustrates another perspective view of the inner components of the motor compartment illustrated in FIG. 13.

With further reference to FIGS. 13-15, the motor 340 is disposed in the inner frame 330 proximate to the rear end 308 of the motor compartment 300. The motor 340 is mechanically coupled, for example via a belt as shown, to a drive pulley 354, which is mechanically coupled to the set of gears 350. Thus, powering the motor 340 causes the components of the drive pulley 354 to rotate, which in turn, causes the set of gears 350 to rotate. As illustrated in FIGS. 14 and 15, the set of gears, or gear train, 350 span forwardly from the motor 340 and the drive pulley 354 through the inner frame 330. The set of gears 350 also extends both downwardly through the inner frame 330 to the lower linkage 370 and upwardly through the inner frame 330 to the upper linkage 360.

The upper linkage 360, which is best illustrated in FIGS. 14 and 15, contains a distal end 362 and a proximal end 364, where the distal end 362 may be coupled to the one of the gears 350 at a location offset from the center of the attached gear. In other words, the distal end 362 of the upper linkage 360 may be coupled to one of the gears 350 in an offset configuration. Moreover, the proximal end 364 of the upper linkage 360 may be coupled to the extension 396 of the upper rotational arm 390. Because the upper linkage 360 is coupled at one end 362 to one of the gears 350 at an offset location and coupled to the horizontal extension 396 at another end 364, rotation of the set of gears 350 causes the upper linkage bar 360 to move substantially linearly in a forward to backward direction between the front end 306 and the rear end 308. This substantially linear movement of the upper linkage 360 causes the extension 396, and thus, the upper rotational arm 390, to rotate about axis A. It then follows that the substantially linearly movement of the upper linkage 360 causes the hanger arm 400 to rotate about axis A.

Unlike the first and second embodiments, the third embodiment of the motor compartment 300 contains two lower gears 356(1), 356(2) extending downwardly from the inner frame 330. Intermeshed with the first and second lower gears 356(1), 356(2) is an intermediate gear 358. The set of gears 350 are mechanically coupled to the first lower gear 356(1), where rotation of the set of gears 350 imparts rotation to the first lower gear 356(1). Because the intermediate gear 358 is intermeshed with both the first lower gear 356(1) and the second lower gear 356(2), when the first lower gear 356(1) is rotated, the second lower gear 356(2) is rotated at the same speed or angular velocity.

The third embodiment of the motor compartment 300 further differs from the first and second embodiments of the motor compartment 300 with the lower linkage 370. The lower linkage 370 of the third embodiment of the motor compartment 300 contains a distal end 371 and a proximal end 372. The lower linkage 370 is coupled to both the first and second lower gears 356(1), 356(2) at locations that are offset from the center of the lower gears 356(1), 356(2). More specifically, the distal end 371 of the lower linkage 370 is coupled to the first lower gear 356(1) via pin 378(1), while an intermediate location of the lower linkage 370, disposed between the distal end 371 and the proximal end 372, is coupled to the second lower gear 356(2) via pin 378(2). The lower linkage 370 is coupled to the first and second lower gears 356(1), 356(2) at locations on the first and second lower gears 356(1), 356(2) that are equally offset from the centers of the first and second lower gears 356(1), 356(2). In addition, a ring 373 is disposed on the proximal end of the lower linkage 370, where the ring 373 is disposed around the hanger arm 400 proximate to the distal end 410 of the hanger arm 400. The ring 373 further includes a gasket 374, which contains an opening 375 that is sized to receive the hanger arm 400. The gasket 374 also is disposed around the hanger arm 400 proximate to the distal end 410 of the hanger arm 400. In other words, the distal end 410 of the hanger arm 400 is inserted through the gasket 374 and the ring 373. The gasket 374 may be constructed from a resilient material, such as, but not limited to, rubber.

By coupling the lower linkage 370 to both the first and second lower gears 356(1), 356(2), rotation of the first and second lower gears 356(1), 356(2), which rotate with the same angular velocity, imparts movement onto the lower linkage 370. The lower gears 356(1), 356(2) rotate about a vertical axes B(1), B(2), respectively. In operation, as the lower gears 356(1), 356(2) rotate, the lower linkage 370 is moved in circular motion in unison with the rotation of the first and second lower gears 356(1), 356(2) without the pin in slot movement of the first embodiment. Thus, unlike the previous embodiments, the opening 375 of the lower linkage 370 is moved in a circular motion such that the opening 375 is moved in a circular path that contains an eccentricity of very near to zero. This motion of the lower linkage 370, coupled with the ring 373 and gasket 374 disposed around the hanger arm 400, causes the hanger arm 400, and subsequently the seat 500, to reciprocally sway in a circular arc around axis A, where the circular arc also contains an eccentricity of almost zero. Similar to the first embodiment of the motor compartment 300, the resiliency of the gasket 374 allows the lower linkage 370 to transmit motion onto the hanger arm 400, while also providing cushioning and dampening to the motion of the hanger arm 400. Thus, the resiliency of the gasket 374 causes the hanger arm 400, and thus the seat 500, to move in a circular curvilinear arc with a smooth, gentle, and continuous motion. The universal joint 380 further enables the hanger arm 400 and the seat 500 to be moved in the circular arc as the operation of the lower linkage 370 imparts the motion onto the hanger arm 400.

Figure 16:
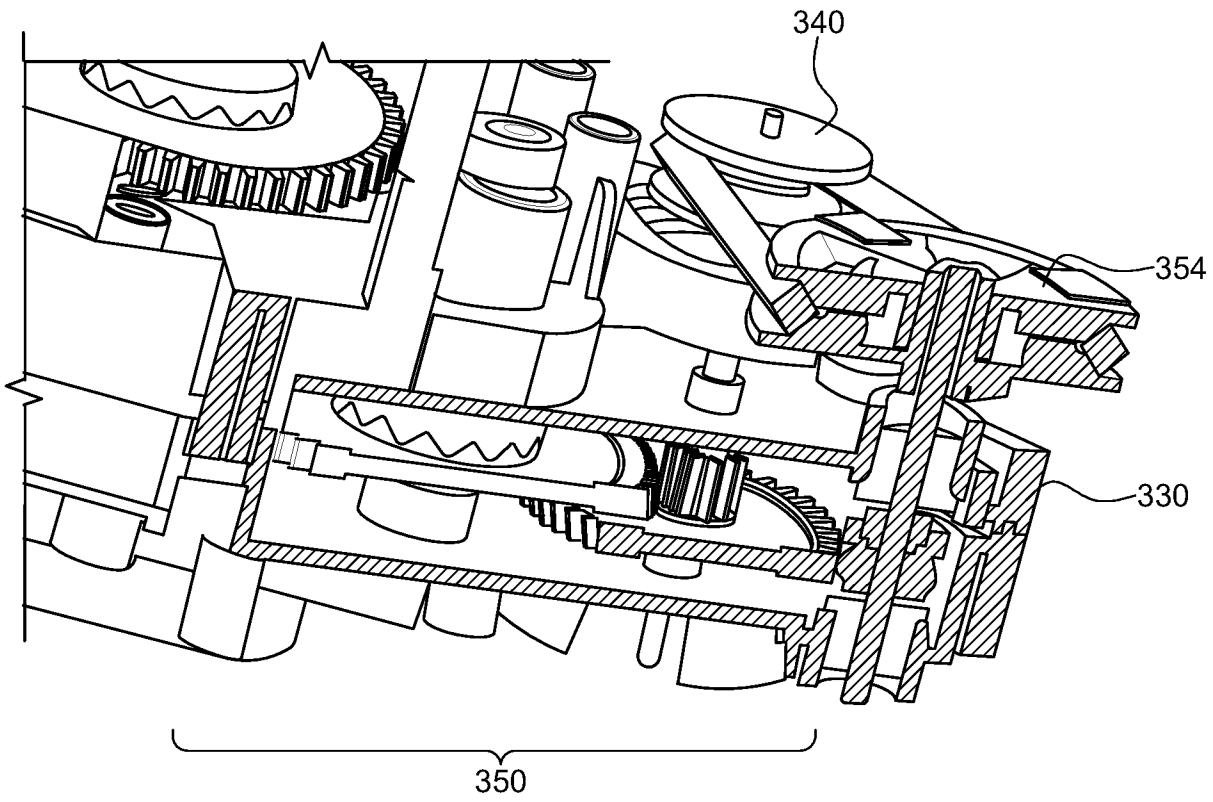
FIG. 16 illustrates a side view of the motor compartment illustrated in FIG. 13, where the motor is oriented in a different orientation.

FIG. 16 further illustrates another, alternate, orientation of the motor 340 and the drive pulley 354 for the third embodiment of the motor compartment 300. As illustrated in FIGS. 13-15, the motor 340 and the drive pulley 354 are in a horizontal orientation, but, as illustrated in FIG. 16, the motor 340 and the drive pulley 354 could be oriented in a vertical orientation. Both motor 340 and the drive pulley 354 are disposed in the inner frame 330 proximate to the rear end 308 of the motor compartment 300, with the motor 340 being mechanically coupled to the drive pulley 354, which is mechanically coupled to the set of gears 350. Thus, powering the motor 340 causes the components of the drive pulley 354 to rotate, which in turn, cause the set of gears 350 to rotate. The orientation of the motor 340 and the drive pulley 354 illustrated in FIG. 16 may operate more quietly than that illustrated in FIGS. 13-15.

Figure 17:
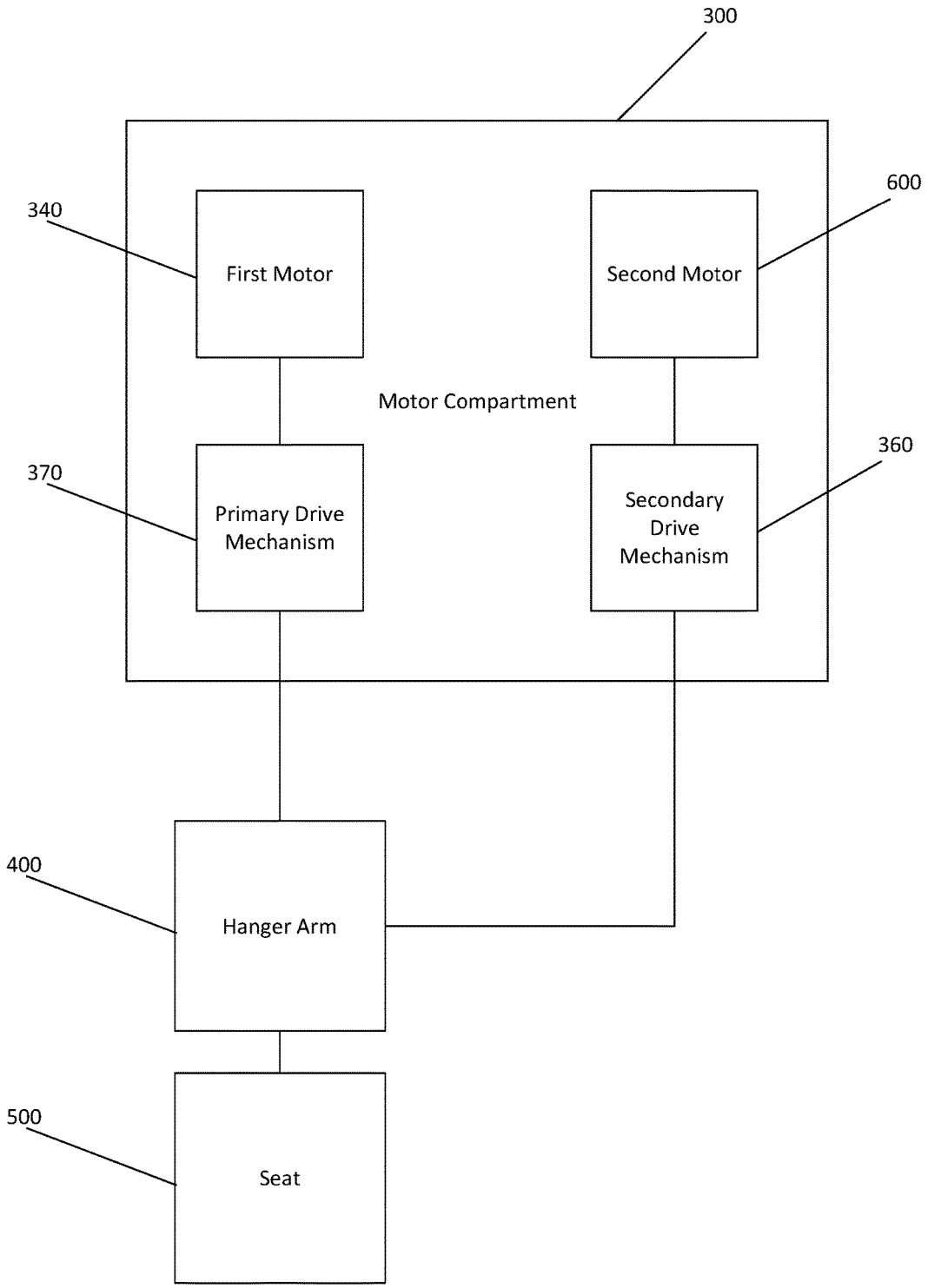
FIG. 17 illustrates a schematic diagram of an another embodiment of an infant support structure that provides two types of simultaneous motions to a seat in accordance with the present invention.

FIG. 17 illustrates a schematic diagram of another embodiment of the infant support 10 in accordance with the present invention. As illustrated, and similar to the previously described embodiments, the motor compartment 300 includes a primary drive mechanism, or lower linkage bar, 370, and a secondary drive mechanism, or the upper linkage bar, 360. As described previously, the primary drive mechanism/lower linkage bar 370 causes the hanger arm 400 and the seat 500 to sway in a substantially circular curvilinear motion through a horizontal plane. Moreover, the secondary drive mechanism/upper linkage bar 360 causes the hanger arm 400 and the seat 500 to rotate or pan about a vertical axis. According to the embodiment illustrated in FIG. 17, the motor compartment 300 also includes a first motor 340 that may be operatively coupled to the primary drive mechanism 370 to drive the primary drive mechanism 370 to sway the hanger arm 400 and the seat 500 in a substantially circular curvilinear motion through a horizontal plane. Furthermore, the motor compartment 300 may further include a second motor 600 that may be operatively coupled to the secondary drive mechanism 360 to drive the secondary drive mechanism 360 to rotate or pan the hanger arm 400 and the seat 500 about a vertical axis.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An infant support comprising:

a base for supporting the infant support above a support surface;

a support arm having a distal end and a proximal end, the distal end of the support arm being coupled to the base and the support arm extending upwardly from the base;

a motor compartment coupled to the proximal end of the support arm, the motor compartment comprising:

a primary drive mechanism, and a motor mechanically coupled to the primary drive mechanism; and a hanger arm descending from the motor compartment, the hanger arm including a distal end coupled to the motor compartment and a proximal end coupled to an infant-receiving seat, where the infant-receiving seat is disposed directly underneath the proximal end of the support arm wherein the distal end of the hanger arm includes a portion that lies within a substantially vertical axis;

wherein the primary drive mechanism is configured to push the portion of the distal end of the hanger arm that lies within the substantially vertical axis out of the substantially vertical axis and impart a circular or elliptical curvilinear swaying of the hanger arm, thereby causing the seat to travel in a substantially horizontal circular or elliptical path.

2. The infant support of claim 1, wherein the infant support further comprises:

the secondary drive mechanism coupled to a motor and configured to rotate the hanger arm and the seat about a substantially vertical axis.

3. The infant support of claim 1, wherein the hanger arm is connected to the motor compartment by a universal joint or a ball and socket joint.

4. The infant support of claim 2, wherein the primary drive mechanism and the secondary drive mechanism simultaneously impart motion to the hanger arm.

5. The infant support of claim 1, wherein the primary drive mechanism includes a primary linkage comprising:

a distal end coupled to a first motor-driven gear in an offset configuration; and a proximal end including a ring disposed around the distal end of the hanger arm.

6. The infant support of claim 5, wherein the ring of the proximal end of the primary linkage includes a gasket.

7. The infant support of claim 2, wherein the secondary drive mechanism includes a secondary linkage comprising:

a distal end coupled to a second motor-driven gear in an offset configuration; and a proximal end coupled to an extension mounted proximate the distal end of the hanger arm.

8. The infant support of claim 2, wherein a single motor is configured to drive the primary drive mechanism and the secondary drive mechanism.

9. The infant support of claim 2, wherein the primary drive mechanism and the secondary drive mechanism are driven by separate motors.

10. The infant support of claim 1, wherein the hanger arm and the seat are disposed beneath the motor compartment and above the base.

11. A motor compartment of an infant support, the motor compartment comprising:

a motor, and a primary drive mechanism mechanically coupled to the motor and a hanger arm of the infant support the hangar arm including a portion that lied within a substantially vertical axis; the primary drive mechanism configured to push the portion of the hanger arm that lies within the substantially vertical axis out of the substantially vertical axis and impart a circular or elliptical curvilinear swaying of the hanger arm, thereby causing an infant seat coupled to the hanger arm and disposed directly underneath the motor compartment to travel in a substantially horizontal circular or elliptical path.

12. The motor compartment of an infant support of claim 11, further comprising:

a secondary drive mechanism coupled to a motor and configured to rotate the hanger arm and the seat about the substantially vertical axis surface that supports the infant support.

13. The motor compartment of an infant support of claim 11, wherein the hanger arm is connected to the motor compartment by a universal joint or a ball and socket joint.

14. The motor compartment of an infant support of claim 12, wherein the primary drive mechanism and the secondary drive mechanism simultaneously impart motion to the hanger arm.

15. The motor compartment of an infant support of claim 12, wherein a single motor is configured to drive the primary drive mechanism and the secondary drive mechanism.

16. The motor compartment of an infant support of claim 12, wherein the primary drive mechanism and the secondary drive mechanism are driven by separate motors.

17. The motor compartment of an infant support of claim 12, wherein:

the primary drive mechanism includes a primary linkage comprising:

a distal end coupled to a first motor-driven gear in an offset configuration;

a proximal end including a ring disposed around a distal end of the hanger arm; and the secondary drive mechanism includes a secondary linkage comprising:

a distal end coupled to a second motor-driven gear in an offset configuration; and a proximal end coupled to an extension mounted proximate the distal end of the hanger arm.

18. A method of imparting motion onto a descending hanger arm of an infant support structure, the method comprising:

driving a primary drive mechanism, the primary drive mechanism being mechanically coupled to the hanger arm of the infant support and a motor disposed within a motor compartment, where the motor compartment is coupled to a top end of an upstanding support arm of the infant support structure, wherein driving the primary drive mechanism imparts a circular or elliptical curvilinear swaying of the hanger arm, thereby causing an infant seat coupled to the hanger arm and disposed directly underneath the top end of the upstanding support arm wherein the distal end of the hanger arm includes a portion that lies within a substantially vertical axis; and to push the portion of the hanger arm that lies within the substantially vertical axis out of the substantially vertical axis and travel in a substantially horizontal circular or elliptical path.

19. The method of claim 18, further comprising:

driving a secondary drive mechanism coupled to a motor and an extension mounted proximate an end of the hanger arm, wherein driving the secondary drive mechanism rotates the hanger arm and the seat about the substantially vertical axis surface that supports the infant support structure.

20. The method of claim 19, wherein the primary drive mechanism and the secondary drive mechanism simultaneously impart motion to the hanger arm.

* * * * *